US006776658B2

(12) United States Patent
Tang

(10) Patent No.: US 6,776,658 B2
(45) Date of Patent: Aug. 17, 2004

(54) CABLE END CONNECTOR

(75) Inventor: Chiu-Yu Tang, Lake Forest, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/214,026

(22) Filed: Aug. 6, 2002

(65) Prior Publication Data

US 2004/0029444 A1 Feb. 12, 2004

(51) Int. Cl.[7] ..... H01R 13/648
(52) U.S. Cl. ..... 439/607; 439/76.1; 439/545
(58) Field of Search ..... 439/607, 610, 439/76.1, 545, 609, 701

(56) References Cited

U.S. PATENT DOCUMENTS 4,756,695 A * 7/1988 Lane et al. ..... 439/76.1
5,934,942 A * 8/1999 Patel et al. ..... 439/610
5,954,523 A * 9/1999 Babcock ..... 439/79
6,109,969 A * 8/2000 Kuo et al. ..... 439/610
6,139,365 A * 10/2000 Lok ..... 439/607
6,162,086 A * 12/2000 Kuo ..... 439/497
6,165,017 A * 12/2000 Kuo ..... 439/610
6,210,216 B1 * 4/2001 Tso-Chin et al. ..... 439/545
6,334,781 B1 * 1/2002 Nishio et al. ..... 439/76.1

OTHER PUBLICATIONS

Chapter 6 of Universal Serial Bus Specification Revision 2.0, Feb. 1998.

* cited by examiner

*Primary Examiner*—Javaid H. Nasri
(74) *Attorney, Agent, or Firm*—Wei Te Chung

(57) ABSTRACT

An electrical cable end connector (1) includes a pair of electrical connector components (2), an electrical cable (3), a pair of latches (4) and a cover (5). Each electrical connector component has an insulative housing (20), a number of electrical contacts (21) mounted to the insulative housing, a printed circuit board (22) electrically connecting with the electrical contacts and a conductive shell (23) enclosing the insulative housing, the electrical contacts and the printed circuit board. The electrical cable includes a number of conductors (33) respectively electrically connecting with the printed circuit boards of the electrical connector components and a metallic braid (32) electrically contacting with the conductive shells of the electrical connector components. The latches are retained to the cover. The cover has a pair of cover members (50) to enclose the electrical connector components therein.

1 Claim, 3 Drawing Sheets

CABLE END CONNECTOR

BACKGROUND OF THE INVENTION

1. Field of the Invention

The present invention relates to an electrical connector, and particularly to an electrical cable end connector which electrically connects with an electrical cable.

2. Description of the Related Art

Cable end connector usually has electrical contacts electrically interconnecting with both conductors of an electrical cable and electrical contacts of a complementary electrical connector to transmit signals therebetween. Chapter 6 of Universal Serial Bus Specification Revision 2.0, which is released by Compaq, Hewlett-Packard, Intel, Lucent, Microsoft, NEC, and Philips on Apr. 27, 2000 and a hard copy of which is enclosed herewith, discloses one kind of cable end connector, Universal Serial Bus (USB) cable end connectors. U.S. Pat. Nos. 6,210,216, 6,305,986 and 6,347,948 issued respectively on Apr. 3, 2001, Oct. 23, 2001 and Feb. 19, 2002 disclose USB cable end connectors in the two-port fashion. U.S. Pat. No. 5,928,035 issued on Jul. 27, 1999 discloses a complementary electrical connector mateable with a USB cable end connector.

As is known to all skilled in the pertinent art, Electromagnetic Interferences (EMI) and Electrostatic Discharge (ESD) are often the most concerned issues in the design of all kinds of electrical connectors. Conventional USB connectors address the EMI and ESD problems of electrical connectors by way of establishing grounding paths through conductive braids of the electrical cables, conductive shells of mated cable end-complementary connectors, and printed circuit boards to which the complementary electrical connector is mounted.

When the speed of the signal transmission of the electrical connector (for example USB 2.0 connector made according to the Universal Serial Bus Specification Revision 2.0) is increased, the electrical connector is confronted with a more stringent requirement with respect to the EMI and the ESD and only the existing EMI path between the conductive braiding, the conductive shell and the printed circuit board can not match the need.

U.S. Pat. No. 5,797,771 issued on Aug. 25, 1998 discloses an electrical cable end connector comprising a printed circuit board therein. However, the printed circuit board therein does not address the problem we concern.

Therefore, an improved electrical cable end connector is desired.

SUMMARY OF THE INVENTION

A major object of the present invention is to provide an electrical cable end connector which incorporates a printed circuit board therein for improving the EMI and/or ESD shielding thereof.

An electrical cable end connector in accordance with the present invention comprises a pair of electrical connector components, an electrical cable, a pair of latches and a cover. Each of the electrical connector components comprises an insulative housing, a plurality of electrical contacts mounted to the insulative housing, a printed circuit board electrically connected with the electrical contacts and a conductive shell enclosing the insulative housing, the electrical contacts and the printed circuit board. The electrical cable comprises a plurality of electrical conductors respectively electrically connecting with the printed circuit boards of the electrical connector components to together with the insulative housing, the electrical contacts and the conductive shells constitute two separate electrical cable end connectors. The cover comprises symmetrical upper and lower cover members to receive the electrical connector components therebetween. The latches are retained in the cover and are electrically contacted with the conductive shells of the electrical connector components.

Other objects, advantages and novel features of the invention will become more apparent from the following detailed description of the present embodiment when taken in conjunction with the accompanying drawings.

DETAILED DESCRIPTION OF THE INVENTION

Figure 1:
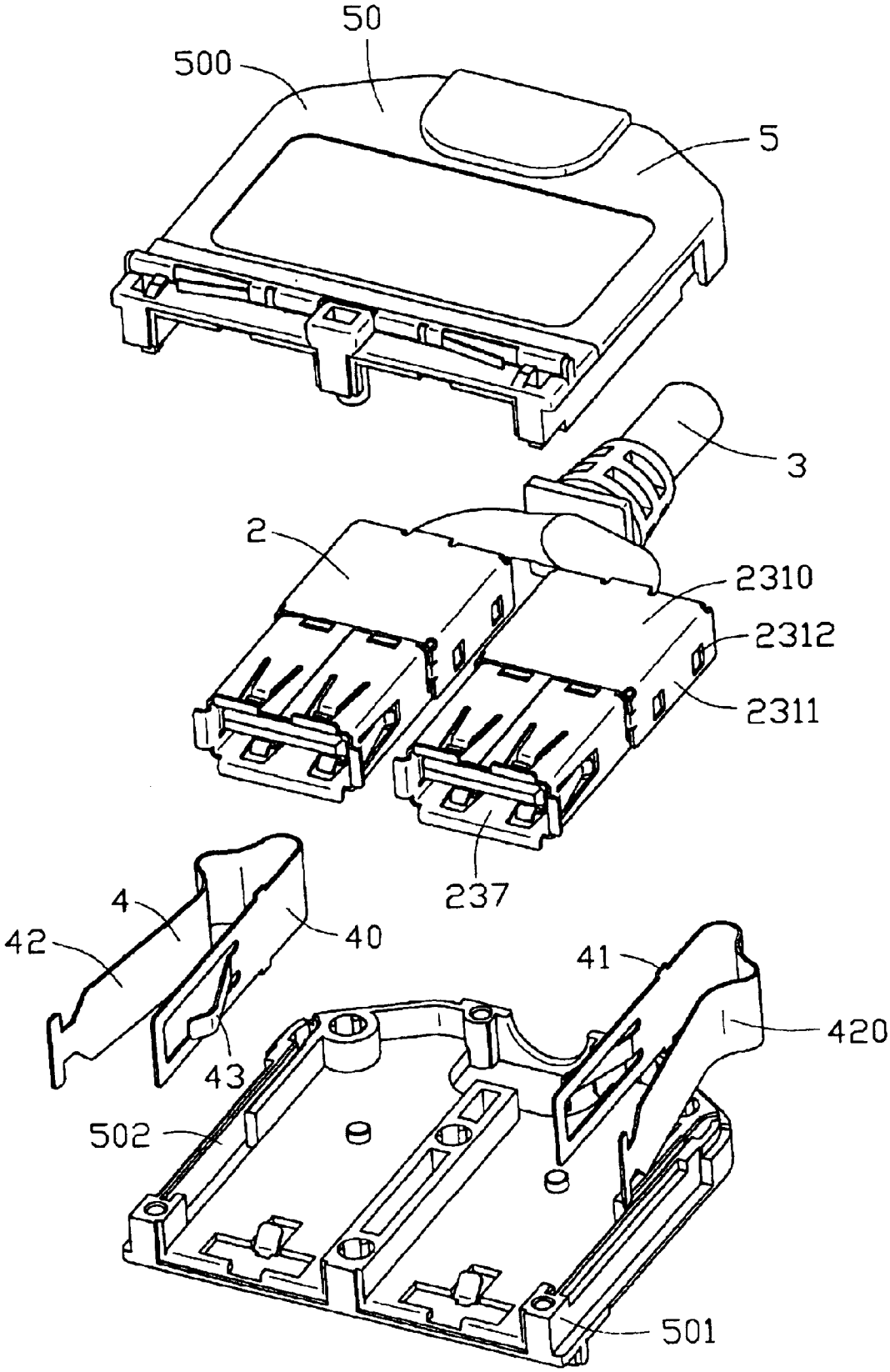
FIG. 1 is an exploded perspective view of an electrical cable end connector in accordance with the present invention.
Figure 2:
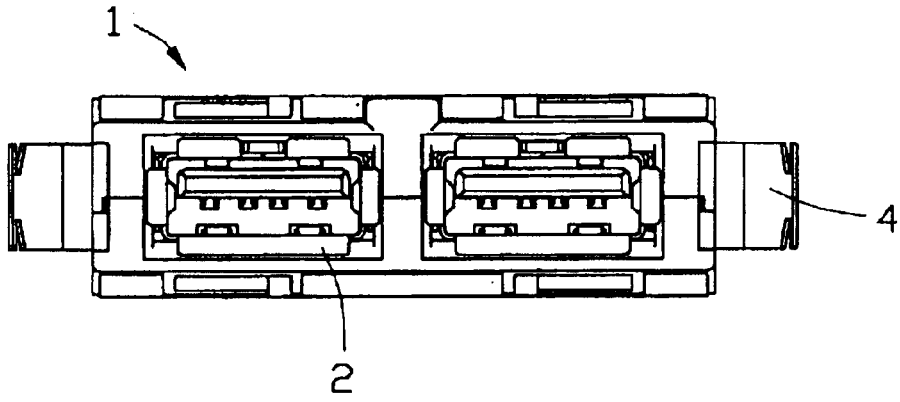
FIG. 2 is a front planar assembled view of FIG. 1.

Referring to FIGS. 1 and 2, an electrical cable end connector in accordance with the present invention and exemplified in the preferred embodiment is a side-by-side two-port Universal Serial Bus (USB) cable end connector 1, although it can be, if desired, any other kinds of electrical cable end connectors known to persons skilled in pertinent art, for example, in a singular port fashion. The electrical cable end connector 1 comprises a pair of electrical connector components 2, an electrical cable 3, a pair of latches 4 and a cover 5.

Figure 3:
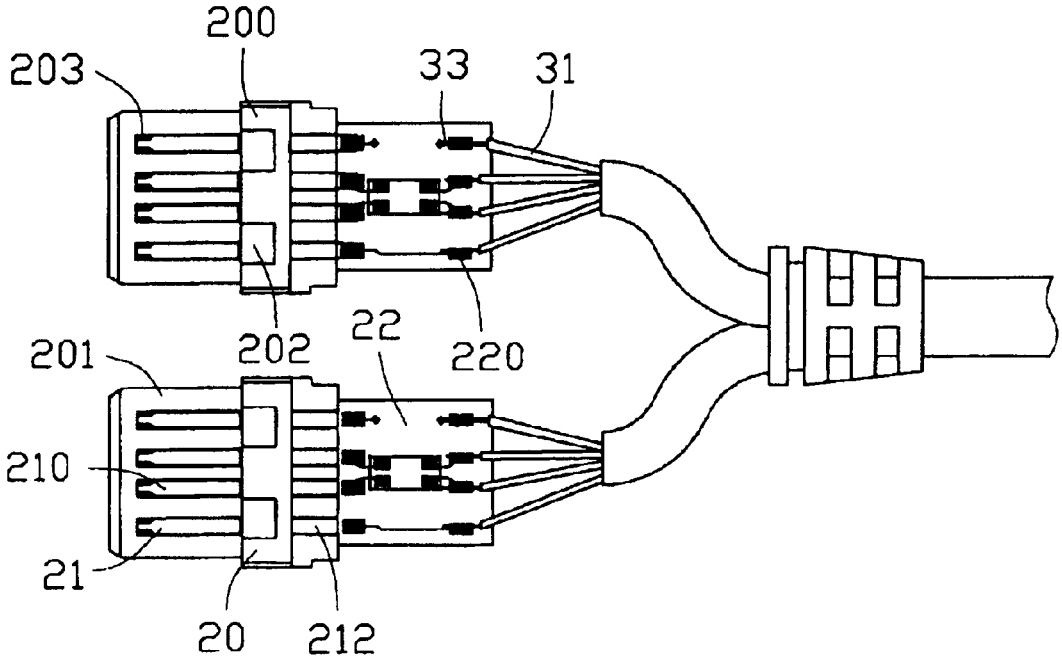
FIG. 3 is a top planar view of FIG. 1 without showing a cover, a pair of latches and conductive shells of electrical connector components of the electrical cable end connector.
Figure 4:
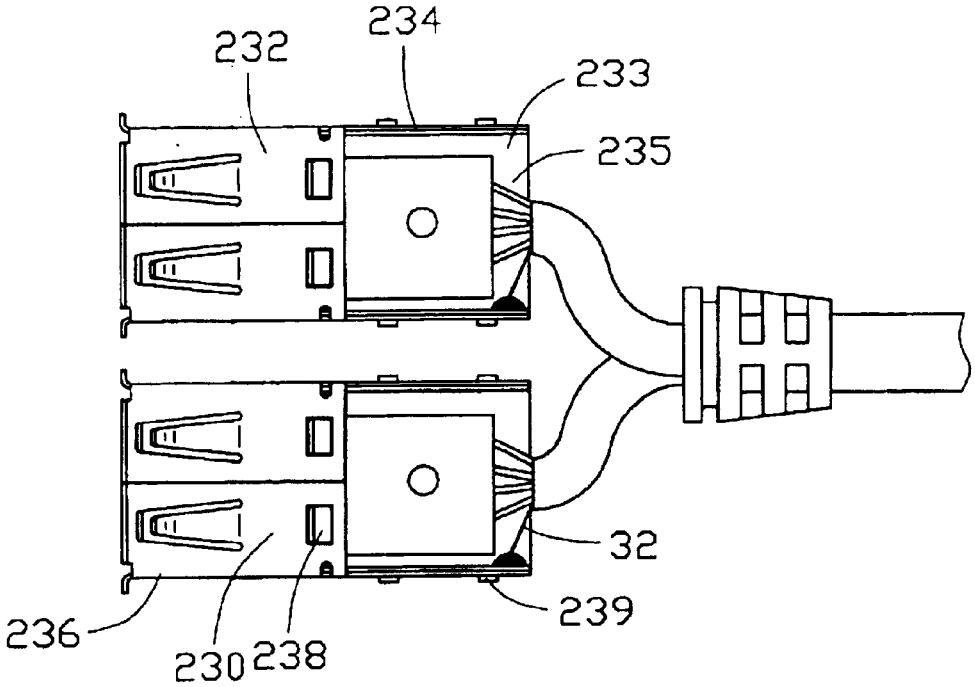
FIG. 4 is a view similar to FIG. 3, but first elements of the conductive shells are shown.
Figure 5:
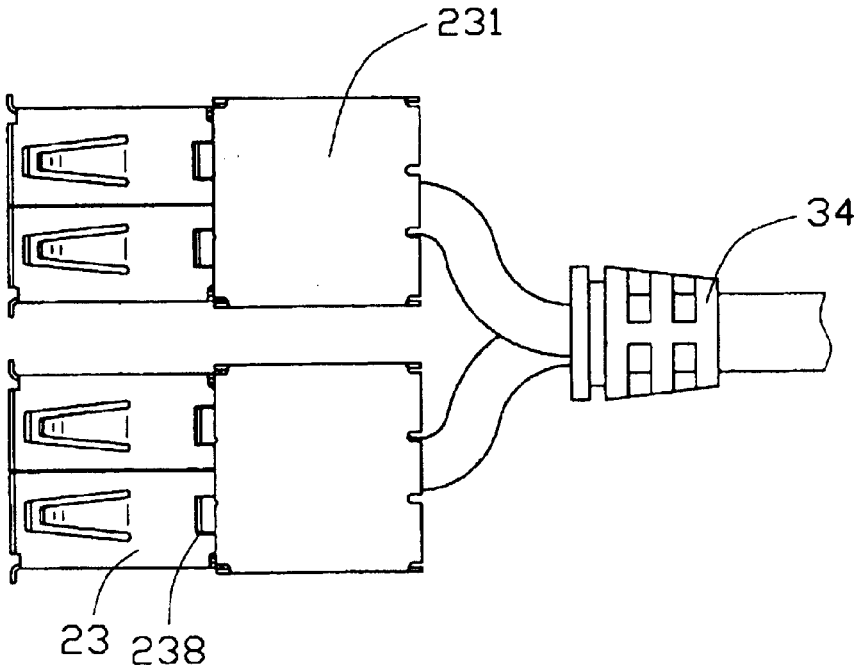
FIG. 5 is a view similar to FIG. 4, but second elements of the conductive shells are shown.

The electrical connector components 2 as exemplified herein are similar to each other although they may, if desired, be dissimilar. Referring also to FIGS. 3–5, each electrical connector component 2 comprises an insulative housing 20, a plurality of electrical contacts 21, a printed circuit board 22, and a conductive shell 23. The insulative housing 20 comprises a base portion 200 and a tongue 201. The base portion 200 is formed with a plurality of blocks 202 thereon. The tongue 22 extends forwardly and rearwardly from the base portion 200. The tongue 22 defines a plurality of passageways 203 recessed therefrom in a front-to-back direction and extending through the base portion 20.

The electrical contacts 21 are received and retained in the passageways 203 and each comprises a mating portion 210 slightly protruding beyond the tongue 201 to engage with electrical contacts of a complementary connector (not shown) and a connecting portion 212 extending rearwardly from the mating portion 210.

The printed circuit board 22 comprises two rows of solder pads 220 and one row of the solder pads 220 are electrically connected with the connecting portions 212 of the electrical contacts 21.

The conductive shell 23 comprises a first element 230 and a second element 231. The first element 230 comprises a hollow-frame-shaped front portion 232 and a rear portion 233 comprising a pair of rear side walls 234 and a rear bottom wall 235 extending respectively rearwardly from a pair of front side walls 236 and a front bottom wall 237 of the front portion 232. The front portion 232 defines a plurality of windows 238 to engage with the blocks 202 of the base portion 200 of the insulative housing 20 to fasten the first element 230 to the insulative housing 20. The rear side walls 234 of the rear portion 233 are formed with a plurality of barbs 239. The second element 231 comprises a top wall 2310 opposite to the rear bottom wall 235 of the rear portion 233 of the first element 230 and a pair of side walls 2311 extending from the top wall 2310. Each side wall 2311 defines a plurality of openings 2312 therein for engaging with the barbs 239 of the rear portion 233 of the first element 230 to assemble the first and the second elements 230, 231 together. In such a way, the insulative housing 20, the electrical contacts 21 and the printed circuit board 22 are all enclosed in the conductive shell 23.

The electrical cable 3 comprises a plurality of wires 31 each comprising a conductor 33 to electrically connect to one of the other row of the solder pads 220 on the printed circuit board 22, a metallic braid 32 electrically connected to the conductive shells 23 of the electrical connector components 2, and a strain relief 34.

Each conductive latch 4 comprises a first leg 40 and a second leg 42 curvedly connected with the first leg 40 and extending substantially parallel to the first leg 40. The first leg 40 comprises a pair of retaining tabs 41 extending outwardly from two opposite sides of a rear portion thereof and a resilient tab 43 extending forwardly adjacent to a front portion thereof. The second leg 42 comprises a curved portion 420 extending in a direction away from the first leg 40.

The cover 5 comprises symmetrical upper and lower cover members 50. Each cover member 50 comprises a body portion 500 and a peripheral portion 501 extending perpendicularly from the body portion 500. The peripheral portion 501 defines a pair of slits 502 for receiving and retaining the first legs 40 of the latches 4, respectively.

In assembly, the electrical connector components 2 respectively together with the cable 3 constitute two separate electrical cable end connectors and are encased between the upper and the lower cover members 50. The first legs 40 of the latches 4 are received in the slits 502 of the peripheral portions 501 with the retaining tabs 41 engaging with the peripheral portions 501 of the upper and the lower cover members 50 to provide a retention therebetween and the resilient tabs 43 extending to electrically contact with the conductive shells 23. The curved portions 420 extend laterally beyond the cover 5.

An EMI shielding path is, as is known to persons skilled in the pertinent art, established between the metallic braids 32, the conductive shells 23, the latches 4 and the complementary electrical connector. In addition, the printed circuit boards 22 are formed herein to improve the EMI shielding of the electrical cable end connector 1 to match the high speed signal transmission requirements. Specifically, the printed circuit boards 22 are adapted in such a way that the electrical cable end connector 1 and/or the electrical connector component 2 remains the original and/or standard dimension as original and can mate with any usual and/or standard complementary electrical connector. Of course, as is known to all of ordinary skill in the pertinent art, the printed circuit board 22 may incorporate herein any fittable electronic components or be formed on any appropriate conductive traces, if desired.

It is noted that regarding applications conventionally the dual-port cable end USB connector is locked on the back panel of the desktop computer (referring to FIG. 1 of the aforementioned U.S. Pat. No. 6,347,948) and electrically connected to the mother board (not shown) therein through a daughter board (not shown) on which the corresponding dual-port receptacle USB connector and some noise suppression components are mounted. In this invention, the daughter board is omitted and the corresponding USB receptacle connector is directly mounted on the mother board (not shown). Understandably, the associated noise suppression components originally on the omitted daughter board are not proper to be mounted on the mother board instead because the space of the mother board is limited. On the other hand, such noise suppression components are also not proper to be built in the receptacle USB connector because the receptacle USB connector should also be kept as smaller as possible to occupy the minimum space on the mother board. Thus, the invention modifies the earlier cable end USB connector as disclosed in the aforementioned U.S. Pat. No. 6,347,948 to include a built-in printed circuit board with capability of optionally mounting the noise suppression components thereon while without increasing the original size thereof. It can be understood that the cable end USB may not be so sensitive to the size increase as the receptacle USB connector because the cable end USB is mainly exposed to the exterior without the space limitations. Secondly, the original dual-port USB connector disclosed in the aforementioned U.S. Pat. No. 6,347,948 already uses the cover to enclose the internal parts, which dimensionally leaves sufficient space around the connection region of the contacts and the wires in the lengthwise direction for compliance with the doubled laterally sized dual-port USB in comparison with the regular signal port one. Thus, the modified dual-port cable end USB connector as presented by the instant invention, will not result in increase of the total size compared with the original dual-port one without the built-in printed circuit boards therein. It is also noted that in the preferred embodiment of the invention, each mating port, i.e., the connector component, has its own built-in printed circuit board and enclosed by its own shell, while such two mating ports are further enclosed by a common cover. This arrangement is deemed essentially mechanically/electrically different from the conventional way mentioned at the beginning of this paragraph.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable end connector assembly comprising:

a pair of electrical connector components, each of said connector components including:

an insulative housing comprising a base portion and a tongue extending through the base portion;

a plurality of electrical contacts extending through the base portion and being retained to the tongue of the insulative housing, each electrical contact comprising a mating portion;

a printed circuit board electrically connecting with the electrical contacts a conductive shell being assembled to the base portion and being spaced from the tongue of the insulative housing, the conductive shell enclosing the insulative housing, the electrical contacts and the printed circuit board therein, the conductive shell comprising a first element comprising a front portion enclosing the mating portions of the electrical contacts and a rear portion comprising a rear side wall, and a second element assembled to the first element and comprising a side wall engaging with the rear side wall of the first element;

an electrical cable comprising a plurality of conductors mechanically retained by and electrically connected with the printed circuit boards of the pair of connector components, respectively; and a pair of cover members receiving the electrical connector components therebetween;

a pair of latches retained by the cover members;

the conductive shell electrically contacting the corresponding latch;

a pair of metallic braids of said cable electrically contacting the corresponding conductive shells, respectively; and each of the printed circuit boards being dimensioned to be substantially smaller than one half of an interior of the cover members an configurably compliant with the corresponding conductive shell.

* * * * *